US008974887B2

(12) United States Patent
Marcalus et al.

(10) Patent No.: US 8,974,887 B2
(45) Date of Patent: Mar. 10, 2015

(54) LOW-FOLD NAPKIN

(71) Applicant: BelleMarque, LLC, West Hazelton, PA (US)

(72) Inventors: Nicholas Marcalus, Sugar Loaf, PA (US); Alec Marcalus, Sugar Loaf, PA (US)

(73) Assignee: BelleMarque, LLC, West Hazleton, PA (US)

( * ) Notice: Subject to any disclaimer, the term of this patent is extended or adjusted under 35 U.S.C. 154(b) by 0 days.

(21) Appl. No.: 13/942,155

(22) Filed: Jul. 15, 2013

(65) Prior Publication Data

US 2014/0030477 A1 Jan. 30, 2014

Related U.S. Application Data

(60) Provisional application No. 61/675,849, filed on Jul. 26, 2012.

(51) Int. Cl.
*A47K 10/16* (2006.01)
*A47G 11/00* (2006.01)

(52) U.S. Cl.
CPC ..... *A47G 11/001* (2013.01)
USPC ..... 428/126; 428/130

(58) Field of Classification Search
CPC ..... A47K 10/16; B65H 2701/1924
USPC ..... 428/126, 130; 221/48
See application file for complete search history.

(56) References Cited

U.S. PATENT DOCUMENTS

| | | | | |
|---|---|---|---|---|
| 2,093,724 | A * | 9/1937 | Horwit | 206/494 |
| 4,143,762 | A * | 3/1979 | Spiegelberg | 206/210 |
| 4,859,518 | A | 8/1989 | Schutz | |
| 5,118,554 | A | 6/1992 | Chan | |
| 5,356,032 | A | 10/1994 | Rhodes | |
| 5,368,188 | A | 11/1994 | Twardowski | |
| 5,565,258 | A | 10/1996 | McConnell | |
| 5,607,754 | A * | 3/1997 | Giles et al. | 428/211.1 |
| 5,690,250 | A | 11/1997 | Gooding | |
| 5,853,845 | A | 12/1998 | McConnell | |
| 6,168,848 | B1 | 1/2001 | Heath | |
| 6,213,346 | B1 | 4/2001 | Skerrett | |
| 6,306,480 | B1 | 10/2001 | Yardley | |
| 6,623,833 | B2 | 9/2003 | Chan | |
| 6,641,894 | B2 | 11/2003 | Bando | |
| 7,097,896 | B2 | 8/2006 | Merrill | |
| 7,611,765 | B2 | 11/2009 | Hochtritt | |
| 7,625,333 | B2 | 12/2009 | Yardley | |
| 7,670,669 | B2 | 3/2010 | Lefvebvre Du Grosriez | |
| 7,939,159 | B2 | 5/2011 | Hochtritt | |
| 2007/0205212 | A1 | 9/2007 | Klingel | |

* cited by examiner

*Primary Examiner* — Alexander Thomas
(74) *Attorney, Agent, or Firm* — Mitchell A. Smolow

(57) ABSTRACT

A folded paper napkin includes paper sheet panels interconnected by fold lines. The folded paper napkin is for dispensing from a paper napkin dispenser having a dispenser opening. A grasping tab is presented to the user at the dispenser opening to retrieve the paper napkin therefrom whether the paper napkin is positioned frontwards or backwards in the dispenser.

17 Claims, 5 Drawing Sheets

LOW-FOLD NAPKIN

CROSS-REFERENCE TO RELATED APPLICATIONS

This application claims priority under 35 U.S.C. §119(e) (1) from U.S. Provisional Patent Application No. 61/675,849, filed on Jul. 26, 2012, for "Low-Fold Napkin," the disclosure of which is incorporated herein by reference.

STATEMENT REGARDING FEDERALLY SPONSORED RESEARCH

Not Applicable.

BACKGROUND

1. Field of Invention

The present invention relates to paper napkins. In particular, the present invention relates to folded paper napkins designed to be inserted in bulk and withdrawn one-at-a-time from a napkin dispenser.

2. Description of Related Art

Paper-napkin dispensers are well known. In their many embodiments, the dispensers allow for the paper napkins to be loaded in bulk and then withdrawn in small quantities. One such dispenser is commonly known as a Low-Fold dispenser. A Low-Folder dispenser has two, opposite faces from which napkins can be dispensed. A Low-Fold dispenser loads from both sides with a folded steel plate or spiral metal/plastic spring coil on either side of the napkins which acts as a spring to move the napkins to either the outer edge or each side of the dispenser as napkins are removed for use by the restaurant patron. Examples of known Low-Fold dispensers include the Palmer N45Tabletop Low-Fold, the San Jamar® H985BK Lowfold, and the TRAEX (Vollrath) 6509-06 NapDisp-Table™, and other generic Low-Fold dispensers or imported origin.

Standard Low-Fold napkins are designed to load into and be dispensed from Low-Fold dispensers. Standard Low-Fold napkins comprise a single ply napkin when completely unfolded that is approximately 10.00" to 12.00" in length between 6.00" and 9.00" in width. In the folded state, as they are when placed in the dispenser, Low-Fold napkins are approximately 4.875" to 5.00" in length (top to bottom of the dispenser) and approximately 3.5" in width (side to side of the dispenser). Furthermore, standard Low-Fold napkins have a "tab" (for the user to pull the napkin from the dispenser) in the napkin length direction of approximately 3.25" to 3.5" of the total length of approximately 5.00". The width of the "tab" is the same width of the folded napkin width of approximately 3.5". Standard Low-Fold napkins are folded in two places along their length in opposite directions. The bottom quarter of the standard Low-Fold napkin is then folded once along their width. When that fold is complete, the bottom portion of the standard Low-Fold napkin is then folded again. The result is a napkin that is thicker at the bottom than the top, with a thin tab protruding along the top edge of the napkin. When packaged and loaded into a Low-Fold dispenser, the standard Low-Fold napkins are stacked on top of each other with each napkin positioned face-up and in the same direction as the napkin underneath and above.

Examples of low-fold napkins commonly distributed to restaurants include North River #2579, Perky II™ 6.75"×12" (3.5"×5"), Perky III Decor™ 5.5"×12" (3.5"×5"), Perky II North River™ 6.5"×12" (3.5"×5"), Perky I™ #25816 9"×12" (3.5"×5"), G.P.™ #32002 6.5"×10", G.P #6392-01 Tidy Nap™ 9"×12", SCA-D3061Tork Universal Dantifold D.N.™ 8.7"×12" (3.5"×5"), SCA-Tork D6311A Thrifty Dantifold Lowfold™ 5.5"×12" (3.5"×5"), Morcon #P-500 Low-Fold Mini D.N.™ 7"×12" (3.5"×5"), Boardwalk #8316 Low-Fold Mini D.N.™ 7"×12" (3.5"×5").

All of the napkins listed above have an approximate folded dimension of 3.5"×5". This approximate dimension is necessary to contain the stack of napkins when pressed into the double sided opening which contains two plates attached on opposite sides to an internal spring. The napkins as pulled by the users from both sides of the dispenser and are moved forward by the spring attached to the two plates at opposite sides of the spring.

A common problem with Low-Fold napkins is the uneven thickness of the folded napkin due to the approximate 1.5" to 1.75" top part of the napkin (above the approximate 3.25" to 3.5" folded tab) in the folded length direction of approximately 5". This part of the approximate 5" folded length lacks the firmness of the portion of the folded napkin comprised of the "tab" which is folded over at 2 or 3 times the thickness of the top part. Therefore, the top part tends to be less firmly pressed into the dispenser causing the napkins at the top of the dispenser to have a propensity to fall forward and come loose from the top of the dispenser. This leads to users grabbing the napkins in multiples if they pull from the top of the dispenser instead of using the folded over "tab" to pull napkins one-at-a-time. Even if the "tab" is properly used to pull a single napkin from the dispenser, the napkins tend to come out more than one-at-a-time due to less firmness of the napkin stack at the top of the dispenser. This results in excessive use of standard Low-Fold napkin and causes restaurants who use low-fold napkins to spend more money than if the napkin was more likely to dispense one-at-a-time in a controlled manner.

There is accordingly a need for a Low-Fold napkin that provides for easy one-at-a-time dispensing from standard Low-Fold dispensers, which reduces napkin waste, that can also be packaged effectively and cheaply in a square manner.

SUMMARY

The present invention is a folded paper napkin that is cut and folded in such a way as to allow the napkin to be inserted into, and withdrawn in a one-at-a-time fashion from, a Low-Fold dispenser and packaged in a square manner. In one embodiment of a napkin consistent with the present invention, the napkin has an unfolded length of approximately 12½" to 13" and an unfolded width of approximately 4¾" to 5". The napkin is then first folded along its width almost in half. Two separate folds are then made along the napkin's width in opposite directions. The completely folded napkin in then ready to be loaded into a Low-Fold napkin dispenser.

The improved Low-Fold napkin consistent with the present invention solves the problem of the napkin corners fitting too loosely in the sides of the dispenser due to the fact that the front of the improved napkin extends all the way to the top of the dispenser's opening where a lip is designed to hold the napkin tightly in the dispenser. Moreover, the folding pattern of the improved napkin creates a two "leading edges" that allow a patron to grasp and pull the napkin in a one-at-a-time fashion. The improved napkin also solves the packaging problem by providing a napkin that has the same thickness throughout its length. This allows each napkin to be stacked evenly one on top of the other, thereby creating a squared napkin stack that can be easily packaged. Finally, when folded, the napkin naturally unfurls to its fully-extended length as the user pulls the napkin from the dispenser.

In another embodiment of a napkin consistent with the present invention, the napkin has an unfolded length of approximately 10¾" and an unfolded width of approximately 4⅞. The napkin is first folded in two places along its width in opposite directions. The original folds are then folded over. The completely folded napkin is then ready to be loaded into a Low-Fold napkin dispenser.

In another embodiment of a napkin consistent with the present invention, the napkin has an unfolded length of approximately 10¾" and an unfolded width of approximately 4⅞. The napkin is first folded in four places along its width in inward directions. The original folds and then folded over. The completely folded napkin is then ready to be loaded into a Low-Fold napkin dispenser.

In addition to solving the problems discussed in the description of the other embodiment, the improved napkin described in the immediately preceding paragraph uses less material and can be manufactured using equipment that is more simple than equipment being used to make known Low-Fold napkins, thereby providing a napkin that is very similar to, except easier to use than, prior napkins which can be manufactured more efficiently and cheaply. Furthermore, an important feature of all embodiments is that when the user pulls the napkin from the Low-Fold dispenser the napkin is easily accessible one-at-a-time and it unfurls as it is removed from the dispenser, therefore presented more surface area of the napkin to be immediately useful compared to standard Low-Fold napkins.

DETAILED DESCRIPTION

Figure 1:
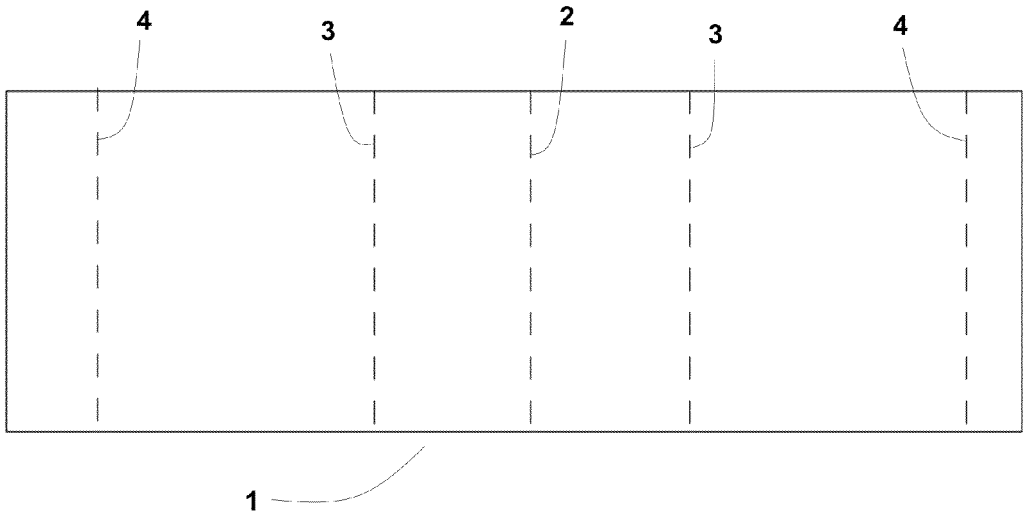
FIG. 1 is a perspective view of one embodiment of the present invention.

The purpose of the invention in all embodiments is to produce a napkin that is uniform in folded thickness with two parallel folded "tabs" running on the two sides of the folded napkin length. The invention in all embodiments results in only a small area less than the thickness of the folded "tabs," approximately 0.25" to 0.5", running in the length (top to bottom of the dispenser), approximately in the middle of the napkin. Therefore, in all embodiments, the present invention results in a folded napkin of approximately 3.5"×5" with two folded "tabs" running parallel to the folded length of the napkin. Depending on which embodiment, the folded "tabs" can be on the same side of the napkin or on opposite sides of the napkin, but for all embodiments the parallel folds with approximately 0.25" to 0.5" separation result in uniform thickness of the folded napkin on both sides in the length direction and on both sides in the width direction. The uniformity of thickness of the folded napkin on all sides results in the stack of napkins holding firmly on all sides of the dispenser and therefore avoiding the tendency of the standard low-fold napkins to be loose at the top of the dispenser. The current invention in all embodiments results in more controlled dispensing from standard low-fold napkin dispensers (listed above) due to the uniformity of thickness on the four sides of the folded napkin which eliminates the possibility of looseness of the napkin stack at the top of the dispenser which is a fault of standard low-fold napkins.

Furthermore, in all embodiments of the current invention packaging of the napkins in paper or plastic bags, as well as paper or plastic tubes is improved because there is no part of the napkin on each of the four folded corners of the napkin which is uneven in thickness. Only a small part in the approximate center of the folded napkin is of less thickness than the four corners of the napkin. This area of uneven thickness in the middle of the folded napkin does not impair packing the napkins with even napkin stack dimension on all sides of the napkin stack. Therefore, in all embodiments of the current invention, the napkins can be stacked evenly in the packaging material resulting in lowering the case dimension compared to standard low-fold napkins for which packaging must be sized to accommodate the "tab" which is usually three times the thickness of the top portion of the folded napkin.

The current invention in all embodiments results in two folded "tabs" of approximately equal thickness running in the direction of the length of the napkin. This, as cited above, results in even thickness of the folded napkin on all four corners, but it also provides the user with a "tab" which runs parallel to the folded length of the napkin which is presented to the user to pull the napkin from the dispenser. The "tabs" running parallel to the folded length result in easy removal of the napkin, one-at-a-time. Furthermore, the firmness of the napkin stack in all four corners of the dispenser result in less possibility that napkins will dislodge from the top part of the dispenser as is the problem with standard low-fold napkins, which result in waste due to the user grabbing more than one napkin.

The current invention in all embodiments results in a napkin which when pulled by either "tab" running in the direction parallel to the folded length of the napkin causes the napkin to open up to present more unfolded dimension of the napkin for use than for standard Low-Fold napkins which open only on the folded over "tab" portion of the napkin when the user pulls it from the dispenser. The current invention, when pulled from the dispenser by the user unfolds as the user pulls it from dispenser along the parallel sides of the folded length of the napkin. The unfolding is not complete as to cause the entire dimension of the unfolded napkin to present for use, but the degree of unfolding is greater than for the standard Low-Fold napkin. Therefore, more area of the napkin is presented to the user upon being pulled from the dispenser and results in the possibility of less napkin usage due to more surface area of the napkin being immediately exposed upon the user pulling the napkin from the dispenser compared to the surface area exposed upon pulling standard Low-Fold napkins from the dispenser.

Napkins manufactured in accordance with the present invention can be manufactured out of any paper material or non-woven substrate. In preferred embodiments, the present invention uses cellulose paper made from conventional tissue and napkin paper machine technology with paper weight of between 10 pounds and 18 pounds basis weight. Basis weight is measured by the weight of 500 sheets with a dimension of 24"×36" which is 3,000 sq feet of total area. Also, the current invention in all embodiments can be produced with paper made with Through Air Dry (TAD) paper making technology as well as from substrates made with non-woven technology. Furthermore, the paper may contain additives to impart wet and dry tensile enhancement as well as softening agents to enhance hand feel or absorptivity. These chemical additives are extensively used in the tissue, towel and napkin paper making industry and are generally well known to paper makers and paper technologists. Although not required, techniques for strengthening and softening paper material or enhancing its appearance (e.g., application of embossing patterns) to achieve desired napkin texture and look are well known to skilled artisans, and any such techniques may be employed to manufacture napkins consistent with the present invention. In preferred embodiments of the present invention, the napkins are either embossed with rubber or steel impression rolls on the napkin folding machine, or the impression can be achieved when the paper substrate is produced on the paper making machine.

Figure 2:
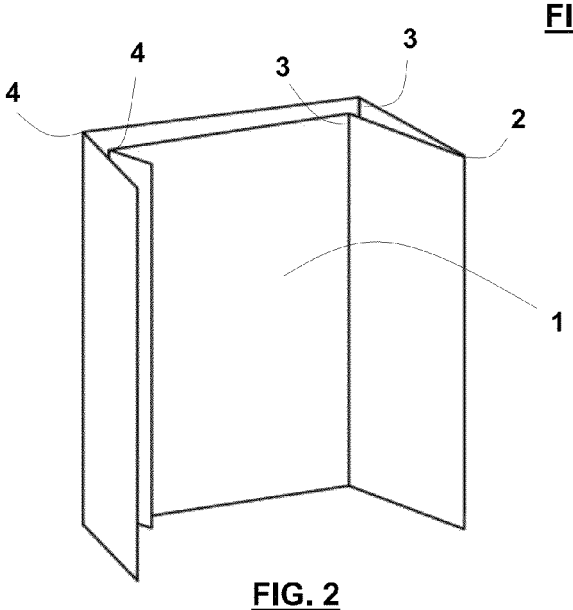
FIG. 2 is a perspective view of one embodiment of the present invention.
Figure 3:
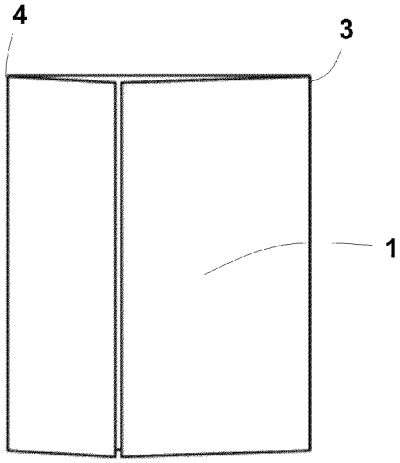
FIG. 3 is a perspective view of one embodiment of the present invention.
Figure 4:
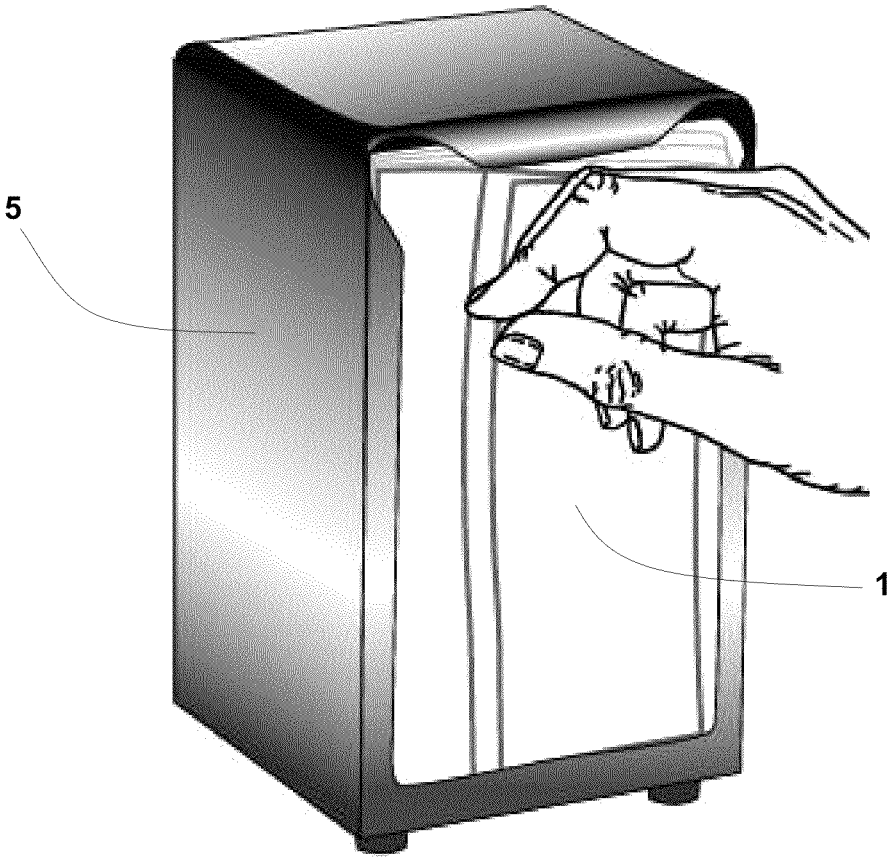
FIG. 4 is a perspective view of one embodiment of the present invention used in a standard Low-Fold napkin dispenser.

Four alternative embodiments of the present invention are disclosed herein. The first is a is shown in FIG. 1, and has an unfolded length in the range of 11" to 13" and an unfolded width of approximately 5". The napkin 1 is then first folded 2 along its width almost in half, as is shown in FIGS. 1 and 2. Two separate folds 3, 4 are then made along the napkin's 1 width in opposite directions as shown in FIGS. 1, 2 and 3. The completely folded napkin 1 is then ready to be loaded into a Low-Fold napkin dispenser 5 as shown in FIG. 4.

Figure 5:
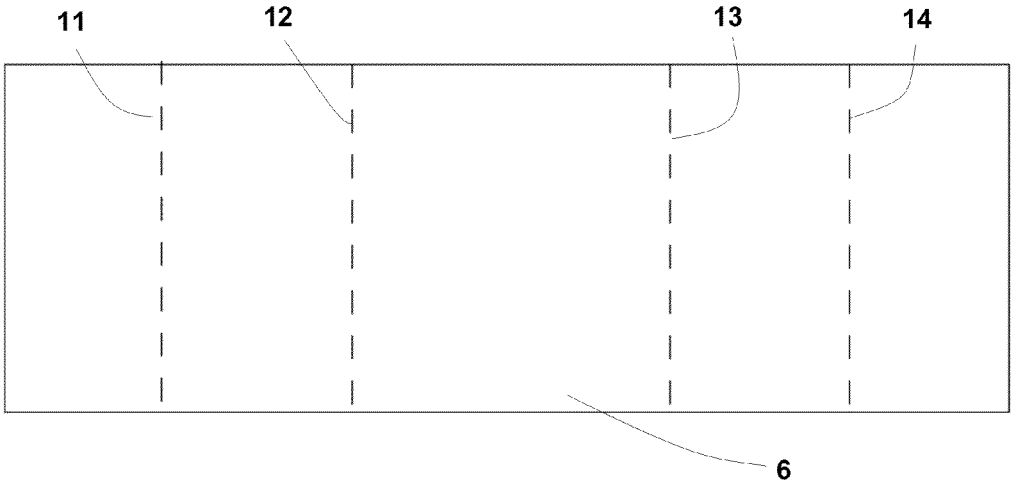
FIG. 5 is a perspective view of one embodiment of the present invention.
Figure 6:
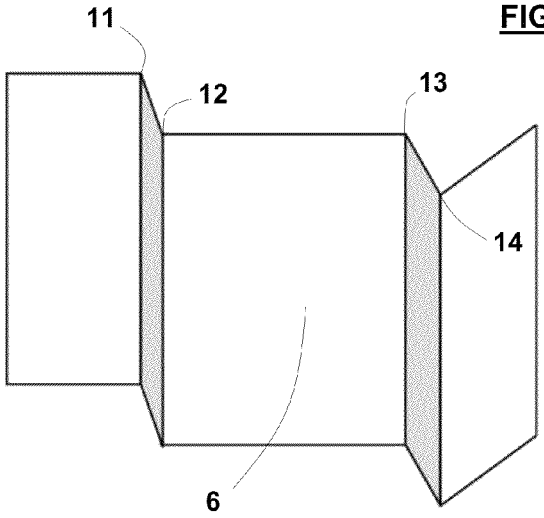
FIG. 6 is a perspective view of one embodiment of the present invention.
Figure 7:
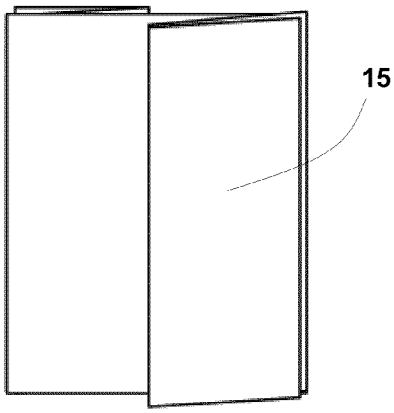
FIG. 7 is a perspective view of one embodiment of the present invention.

In the second embodiment of a napkin consistent with the present invention as is shown in FIG. 5, the napkin 6 has an unfolded length in the range of 10½" and 13½" and an unfolded width of approximately 5". The napkin 6 is folded in four places (11, 12, 13, 14) along its width in opposite directions as shown in FIGS. 5 and 6 forming an accordion fold, so that the folded napkin 15 eventually lies flat as is shown in FIG. 7. The completely folded napkin 15 is then ready to be loaded into a Low-Fold napkin dispenser.

Figure 8:
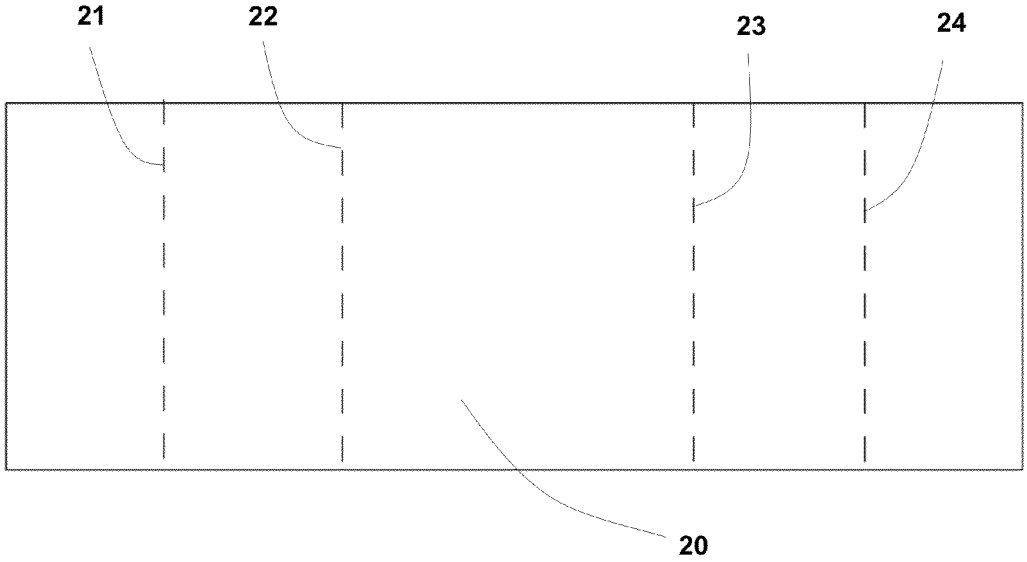
FIG. 8 is a perspective view of one embodiment of the present invention.
Figure 9:
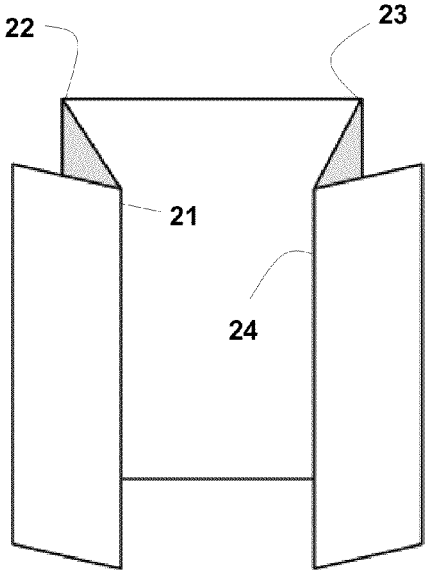
FIG. 9 is a perspective view of one embodiment of the present invention.
Figure 10:
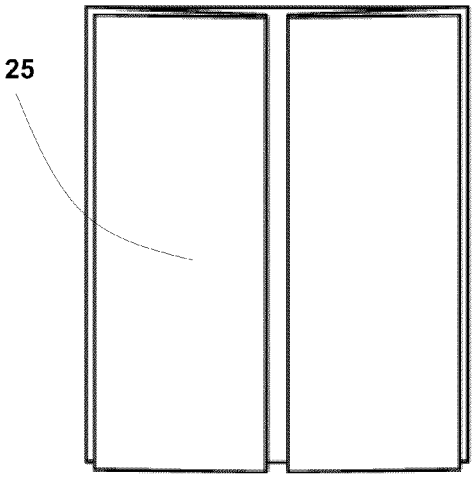
FIG. 10 is a perspective view of one embodiment of the present invention.

In the third embodiment of a napkin consistent with the present invention as is shown in FIG. 8, the napkin 20 has an unfolded length in the range of 10½" and 13½" and an unfolded width of approximately 5". The napkin 20 is first folded in four places (21, 22, 23, 24) along its width in inward directions as shown in FIGS. 8 and 9, so that the folded napkin 25 lies flat as is shown in FIG. 10. The completely folded napkin 25 is then ready to be loaded into a Low-Fold napkin dispenser.

Figure 11:
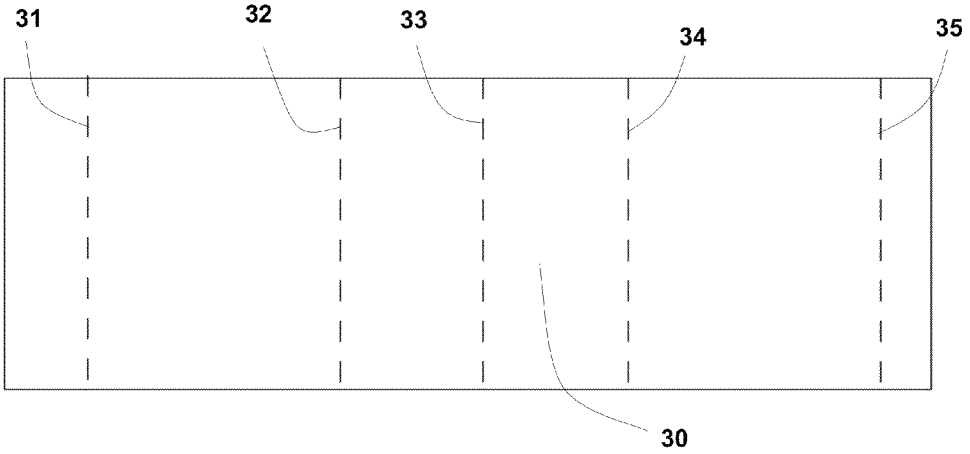
FIG. 11 is a perspective view of one embodiment of the present invention.
Figure 12:
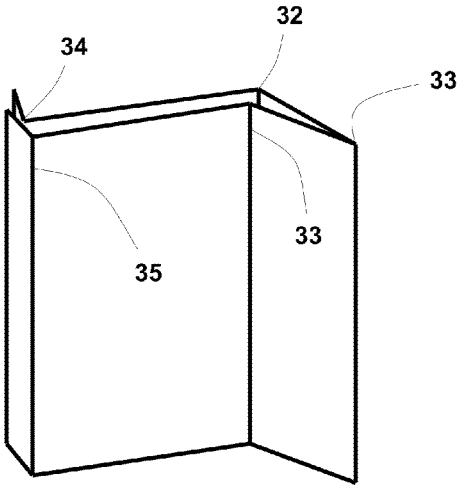
FIG. 12 is a perspective view of one embodiment of the present invention.
Figure 13:
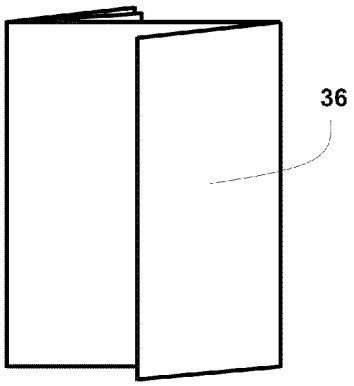
FIG. 13 is a perspective view of one embodiment of the present invention.

In the fourth embodiment of a napkin consistent with the present invention as is shown in FIG. 11, the napkin 30 has an unfolded length in the range of 10½" and 13½" and an unfolded width of approximately 5". The napkin 15 is first folded in five places (31, 32, 33, 34, 35) along its width almost in half, as shown in FIGS. 12 and 13, so that the folded napkin 35 lies flat as is shown in FIGS. 12 and 13. The completely folded napkin 35 is then ready to be loaded into a Low-Fold napkin dispenser.

What is claimed is:

1. A folded napkin formed from a unitary sheet of material, the folded napkin comprising:

a sheet of material having four fold lines extending along four respective unfolded length of the material; and an accordion fold along the four fold lines creating a front folded tab, a back folded tab, and a non-folded area therebetween, the non-folded area having a thickness less than a thickness of a folded tab and a width of about 0.25" to about 0.5".

2. The folded napkin of claim 1 wherein the sheet of material comprises an unfolded width of about 10½" to about 13½" and an unfolded length of about 4⅞" to about 5".

3. The folded napkin of claim 2 wherein the non-folded area extends along a length of the napkin.

4. The folded napkin of claim 3 wherein the non-folded area is positioned about the middle of the napkin.

5. The folded napkin of claim 4 wherein the front and back folded tabs run parallel to a folded length of the napkin.

6. The folded napkin of claim 5 wherein all folded napkin sides are essentially uniform in thickness.

7. The folded napkin of claim 5 wherein all folded napkin corners are essentially uniform in thickness.

8. The folded of claim 5 wherein the napkin is essentially of uniform thickness except for the non-folded area.

9. The folded napkin of claim 8 wherein the unitary sheet is single ply paper and the folded napkin is about 3.5"× about 5".

10. The folded napkin of claim 5 wherein the front and back folded tabs are of essentially equal thickness.

11. The folded napkin of claim 2 wherein the non-folded area is positioned about the middle of the napkin.

12. The folded napkin of claim 11 wherein the front and back folded tabs run parallel to a folded length of the napkin.

13. The folded napkin of claim 1 wherein the non-folded area extends along a length of the napkin.

14. The folded napkin of claim 1 wherein the non-folded area is positioned about the middle of the napkin.

15. The folded napkin of claim 1 wherein all folded napkin sides are essentially uniform in thickness.

16. The folded napkin of claim 1 wherein all folded napkin corners are essentially uniform in thickness.

17. The folded napkin of claim 1 wherein the napkin is essentially of uniform thickness except for the non-folded area.

* * * * *